US008025463B2

(12) United States Patent
Foo et al.

(10) Patent No.: US 8,025,463 B2
(45) Date of Patent: Sep. 27, 2011

(54) OFFSHORE FOUNDATION SYSTEM WITH INTEGRAL ELEMENTS FOR PRELOADING AND EXTRACTING

(75) Inventors: Kok Seng Foo, Singapore (SG); Chin Kau Quah, Singapore (SG); Okky Ahmad Purwana, Singapore (ID); Mark Jason Cassidy, Shenton Park (AU); Christophe Rene Henri Gaudin, Nedllands (AU)

(73) Assignees: Keppel Offshore & Marine Technology Centre Pte Ltd, Singapore (SG); University of Western Australia, Crawley (AU)

( * ) Notice: Subject to any disclaimer, the term of this patent is extended or adjusted under 35 U.S.C. 154(b) by 146 days.

(21) Appl. No.: 12/473,285

(22) Filed: May 28, 2009

(65) Prior Publication Data

US 2009/0297276 A1 Dec. 3, 2009

(30) Foreign Application Priority Data

Jun. 2, 2008 (SG) ..... 200804224-4

(51) Int. Cl.
*E02D 5/74* (2006.01)

(52) U.S. Cl. ..... 405/224.1; 405/224; 405/226

(58) Field of Classification Search ..... 405/224, 405/224.1, 226, 195.1
See application file for complete search history.

(56) References Cited

U.S. PATENT DOCUMENTS

| | | | | |
|---|---|---|---|---|
| 3,241,324 | A * | 3/1966 | Storm et al. | 405/196 |
| 3,996,754 | A * | 12/1976 | Lowery | 405/197 |
| 4,265,568 | A | 5/1981 | Herrmann et al. | |
| 4,432,671 | A * | 2/1984 | Westra et al. | 405/226 |
| 4,668,127 | A | 5/1987 | Steele | |
| 4,721,415 | A * | 1/1988 | Shatto | 405/224.1 |
| 4,830,541 | A * | 5/1989 | Shatto | 405/226 |
| 6,481,932 | B1 * | 11/2002 | Riemers | 405/224.1 |
| 6,488,446 | B1 * | 12/2002 | Riemers | 405/224.1 |
| 7,001,108 | B2 | 2/2006 | Purvis et al. | |
| 7,217,066 | B2 * | 5/2007 | O'Sullivan | 405/224 |
| 7,407,342 | B2 * | 8/2008 | Seidel | 405/224.1 |

* cited by examiner

*Primary Examiner* — Frederic L Lagman
(74) *Attorney, Agent, or Firm* — Pyprus Pte Ltd

(57) ABSTRACT

The present invention describes an offshore foundation system (10,10*a*,10*b*) that is operable for preloading after self-weight installation on a seabed without relying on additional or external ballasts. The foundation system (10,10*a*,10*b*) is also operable for extraction by reversing the process of pre-load operation. In one embodiment, the foundation system (10) comprises a reaction base (20) and suction compartment (60). In another, the foundation system (10*a*,10*b*) comprises a plurality of units of reaction base (20) and suction compartments (60), with the units being connected by bridging structures (21). In yet another, the foundation system comprises a reaction base (20) and a plurality of suction compartments (60). A closed-top of the suction compartment (60) projects above the reaction base (20) so that, in use, there is a gap h between a top of a soil plug inside a suction compartment (60) and its closed-top.

11 Claims, 4 Drawing Sheets

Undrained Preloading

Drained Preloading

OFFSHORE FOUNDATION SYSTEM WITH INTEGRAL ELEMENTS FOR PRELOADING AND EXTRACTING

RELATED APPLICATION

The present invention claims priority to Singapore patent application No. 200804224-4 filed on Jun. 2, 2008, the disclosure of which is herein incorporated in its entirety.

FIELD OF INVENTION

The present invention relates to a new foundation system for offshore structures having integral elements for both preloading during installation and extracting during removal.

BACKGROUND

Foundations of permanent and mobile offshore structures have been undergoing evolution over the past five decades. The use of gravity base, pile, or mat foundations for platform structures in the early periods of offshore oil and gas drilling have clearly shifted to the deployment of caisson or spud-can type foundations. In the last two decades, the latter types are becoming more popular when mobile jack-up rigs are deployed for oil/gas drilling and production.

The foundation of an offshore structure is typically subjected to combined loads due to its self-weight and environmental forces; the environmental forces include lateral and over-turning loads created by wind, wave, and currents acting on the structures; seismic loads; and so on. To anticipate the expected maximum foundation loads that may occur during the structure's service life, the foundation is normally preloaded or proof-loaded to ensure that the foundation can provide the designed bearing capacities with an adequate safety margin. As is in practice, preloading is typically carried out by imposing static gravity loads, being equivalent to the anticipated maximum load, on the foundations and maintaining the loads for a certain period of time until no further settlement of the foundations occurs. Such a direct preloading method has been proven to be effective and is currently practiced.

Despite development of various established foundation types and proven preloading method, in some situations, existing foundation systems cannot offer technically and economically viable foundation solutions for mobile offshore structures. For example, mat foundation system is commonly used to support a mobile offshore platform installed on soft seabed by spreading the working load over a relatively large bearing or contact area. In spite of the resulting low bearing pressure under the foundation, the mat foundation still suffers from potential tilting, possibly due to load eccentricity and differential soil settlement, as well as potential horizontal instability occurring during service. In another example, the use of spud cans on soft seabed will typically lead to considerably deep leg penetration, which in turn results in difficulty in extracting the legs. When compressive load is predominant, conventional caisson foundations may not be an economically viable option with soft seabed because large diameter or deep-skirted caissons are required to provide sufficient foundation resistance.

The conventional preloading method also poses some potential risks, particularly when a mobile offshore platform supported by spud cans is preloaded on irregular seabed surface or punch-through prone areas; sliding or sudden penetration of any of the legs under preload can impose eccentric loads on the platform which in turn may create excessive bending moments on the legs and braces; this often leaves the rig operator with insufficient time to respond.

Apart from the potential risks associated with complexity of seabed conditions, the conventional preloading method also has some fundamental limitations. For example, foundation preloading for jack-up rigs is typically achieved by pumping sea water into ballast tanks located in the rigs' hull. These ballast tanks contributed to additional deadweights to the rigs which translates to additional loads on each leg. However, when large loads are required to 'proof-test' foundations located in harsh offshore environments or deep waters, increasing the volume of ballast tanks to meet the proof load requirements may not necessarily be always acceptable. On the other hand, for other types of independent offshore structures, such as minimum platforms or subsea storage tanks, providing ballast tanks solely for preloading purposes may not be an economical solution; providing for external ballast tanks may not be economical either.

Thus far, mat foundation system is normally adopted for mobile offshore platforms operating particularly in soft seabed. Some mat foundations have been modified to overcome somewhat problematic seabed conditions or operational constraints. For example, U.S. Pat. No. 4,668,127, issued to Bethlehem Steel Corp, uses pivotable mat-platform leg connections and multiple spuds extending downwardly on the mat base to tackle sloping seabed problem and lateral stability issue. In another example, U.S. Pat. No. 7,001,108, issued to Purvis, et al., provides a rig with a mat that has a central opening to overcome difficulties associated with the need for ballasting/deballasting the mat's compartments. The mat has buoyancy that supports the hull and legs in a floating position when the rig is in transit, whilst allowing the mat to be lowered to the sea bottom without assistance of ballasting/deballasting pumps. In another example, U.S. Pat. No. 4,265,568, assigned to The Offshore Company, uses spaced-apart reaction members to spread load to the seabed, instead of using a large single mat or gravity base, in attempts to overcome foundation rotational stability issues. The reaction members are allowed to penetrate into the seabed so that a bottom of the supported structure is not in contact with the seabed. In soft seabed condition, however, relatively massive reaction members may be required to resist the design vertical load.

The relatively large area of a mat or reaction members required to provide stability for its deployment on soft seabed remains an unresolved main drawback of such foundation systems. In addition, the conventional preloading method, i.e. by adding ballasts in the mat's compartments and platform's hull may cause uneven bearing pressure or differential settlement due to potential lateral variability of the seabed. The dependency on ballast tank to facilitate preloading may also hinder known foundation systems from being deployed in deeper waters or when ballasting method is not technically viable due to specific constraints such as that associated with total weight or stability of the structure.

It can thus be seen that there exists a need for a new foundation system that is viable for any seabed condition, in particular soft seabed, yet offering ease in installation/removal and stability during operation. With the industry shift to the use of mobile structures for offshore oil/gas drilling and production in harsher environments and deeper waters, there also exists a need to equip the new foundation system with integral elements which would enable preloading without reliance on ballast tanks and facilitating removal of the foundation.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalized form as a prelude to the detailed description that is to follow.

In one embodiment, the present invention provides an offshore foundation system comprising: i) a reaction base in the form of a hollow slab, which has an upper surface and a bottom surface, the upper and bottom surfaces defining a thickness of the reaction base; and ii) a suction compartment in the form of a substantially open-bottom and closed-top cylindrically elongate shell; wherein the suction compartment is integrally formed with the reaction base so that the open-bottom of the suction compartment opens downward with a longitudinal axis of the elongate shell substantially perpendicular to the bottom surface of the reaction base and the closed-top projects a distance H above the bottom surface of the reaction base, such that, in use, there is a gap h between a top of a soil plug inside the suction compartment and the closed-top.

In another embodiment, the present invention provides a method for installing and preloading an offshore foundation system, the method comprising: i) forming the offshore foundation system according to any one of claims 1-6; ii) submerging the offshore foundation system so that the suction compartment(s) penetrate into the seabed under substantial self-weight of the foundation system; iii) closing vent hatches and valves associated with the or respective suction compartment; iv) once water inside the or respective suction compartment is sealed, operating a suction pump associated with the or respective suction compartment to pump water out from inside the or respective suction compartment so that a negative pressure differential with respect to the ambient hydrostatic pressure at the top of the or respective suction compartment generates a force to push the entire foundation into the seabed; and v) continuing with the suction-induced driving of the or respective suction compartment into the seabed until the bottom surface of the associated reaction base penetrates further into the seabed so that the resulting soil bearing pressure reaches a predetermined value and a gap h between a top of a soil plug and the closed-top of the or respective suction compartment remains, without relying on additional or external ballasts.

In an embodiment of the foundation system, the suction compartment comprises a plurality of suction compartments. In another embodiment, the foundation comprises a plurality of reaction base/suction compartment foundation system units, wherein said foundation units are connected by bridging structures to form an integral base. In another embodiment, in each reaction base/suction compartment foundation system unit, one or more suction compartments are associated with each reaction base. In another embodiment, the offshore foundation system comprises a frame structure disposed on the upper surface of the reaction base to facilitate mating with an upper structure. In yet another embodiment, the reaction base comprises bulkheads that separate the interior of the hollow slab into tanks, which are operable as ballast or storage tanks.

In an embodiment of the offshore foundation installation and preloading method, suction-induced driving of the or respective suction compartment is continued until the associated reaction base reaches a predetermined penetration. In another embodiment, suction-induced driving of the or respective suction compartment is continued for a period of time until no further substantial soil penetration occurs and the soil underneath the foundation system is consolidated. In yet another embodiment, the offshore foundation system is operable for extraction by pumping water into the gap h when the vent hatches and valves are closed.

BRIEF DESCRIPTION OF THE DRAWINGS

This invention will be described by way of non-limiting embodiments of the present invention, with reference to the accompanying drawings, in which.

DETAILED DESCRIPTION

Figure 1:
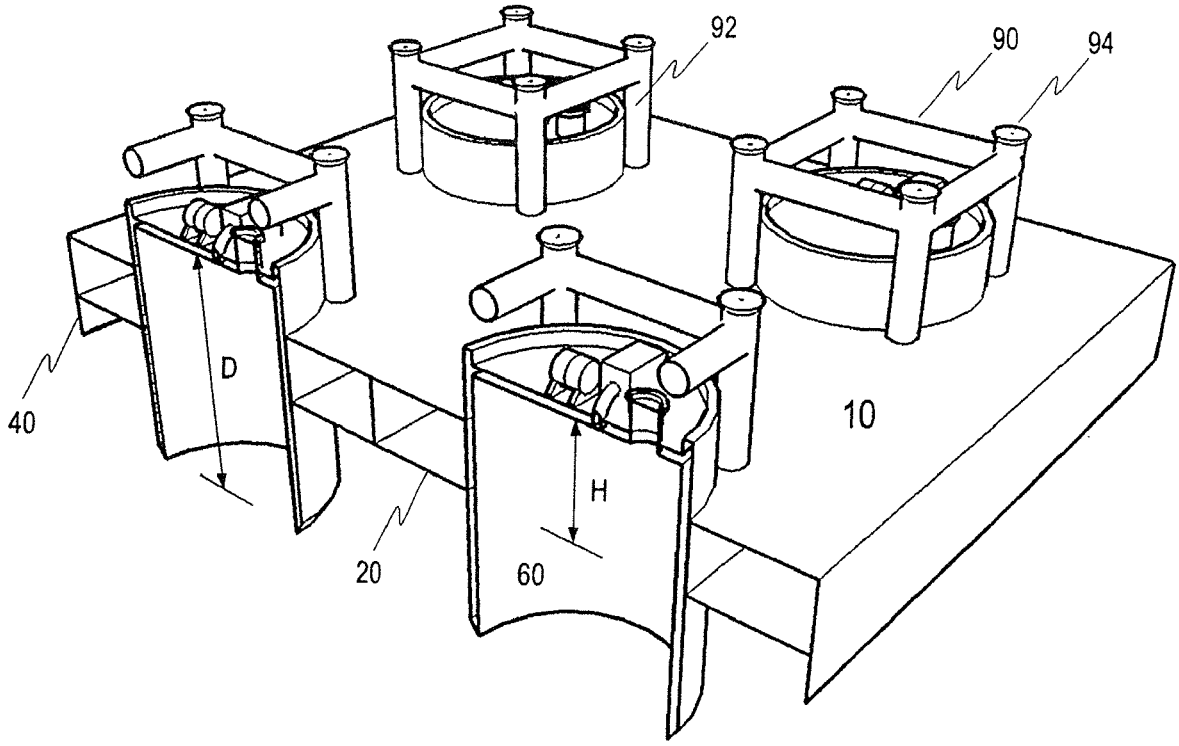
FIG. 1 illustrates part perspective of an offshore foundation system in accordance with an embodiment of the present invention.

One or more specific and alternative embodiments of the present invention will now be described with reference to the attached drawings. It shall be apparent to one skilled in the art, however, that this invention may be practiced without such specific details. Some of the details may not be described at length so as not to obscure the invention. For ease of reference, common reference numerals or series of numerals will be used throughout the figures when referring to the same or similar features common to the figures.

FIG. 1 shows a part perspective of an offshore foundation system 10 according to an embodiment of the present invention. As shown in FIG. 1, the foundation system 10 is made up of a reaction base 20 and four spaced apart suction compartments 60. The reaction base 20 is a substantially flat hollow slab. Each suction compartment 60 is substantially an open-bottom cylindrical shell with a length or depth D. Each suction compartment 60 is aligned and connected substantially perpendicular to the flat reaction base 20 such that a closed top of the suction compartment 60 is a distance H from a bottom of the reaction base 20. Preferably, the suction compartments 60 are evenly spaced apart within the reaction base 20. In addition, the reaction base 20 has a peripheral skirt 40 around its bottom periphery; the peripheral skirt 40 is relatively short with respect to the suction compartment depth D. As shown in FIG. 1, the top of each suction compartment 60 is surrounded by a frame structure 90. Each frame structure 90 is connected to an upper surface of the reaction base 20 by columns 92. The frame structure 90 serves as a connecting element between the foundation system 10 and an upper structure (not shown in the figures). Each free end of the columns 92 has a funnel-shaped receptacle 94 to facilitate positioning or mating between the foundation system and the upper structure.

In an embodiment, the offshore foundation system 10 is operable as a stand-alone structure, for example, to support a subsea storage tank. In another embodiment, the frame structures 90 are operable to dock with matching parts of an upper structure, such as a jacket platform or mobile jackup rig.

Figure 2:
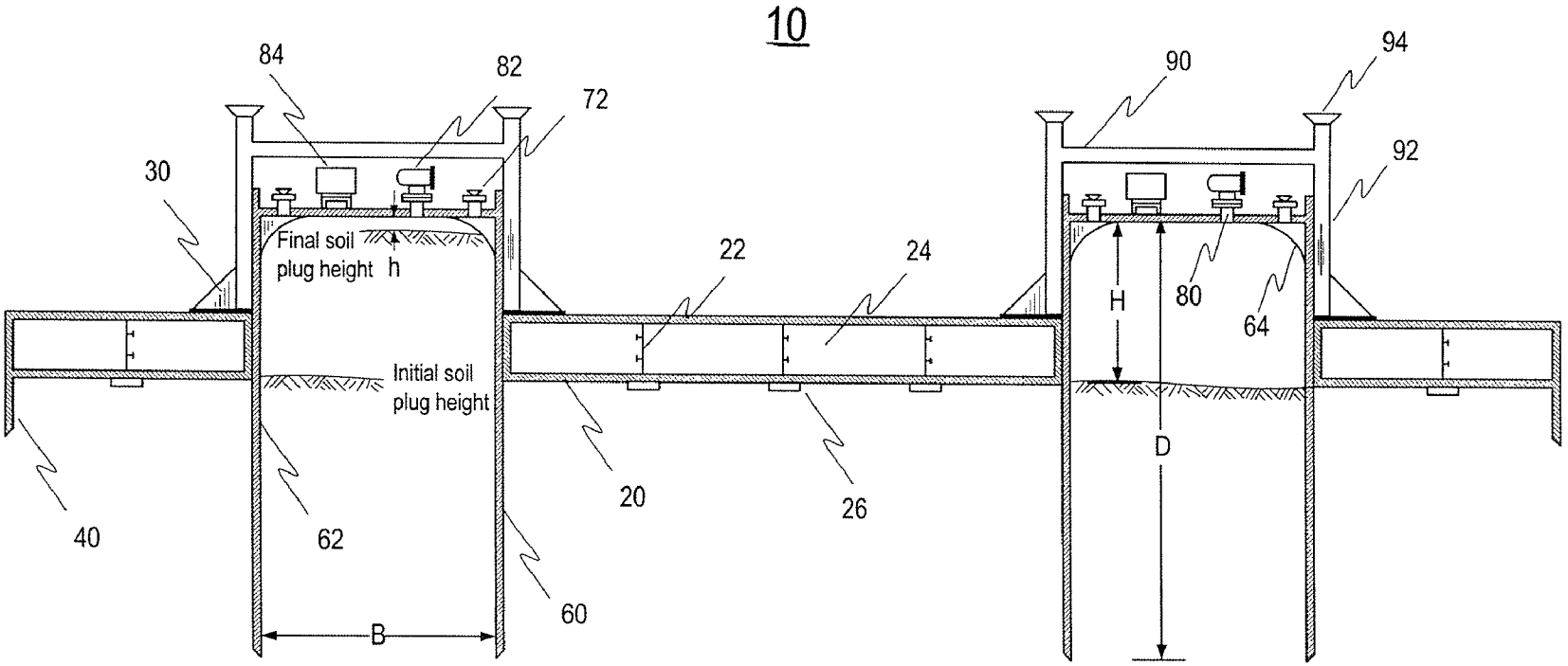
FIG. 2 illustrates a cross-sectional view of the embodiment shown in FIG. 1.

FIG. 2 shows a typical cross-section of the offshore foundation system 10 shown in FIG. 1. As shown in FIG. 2, the reaction base 20 and suction compartments 60 are fabricated as an integral unit. The hollow interior of the reaction base 20 is equipped with bulkheads 22 to provide strength and rigidity to the reaction base 20 in spreading the working load to the soil underneath the foundation system 10. The bulkheads 22 also separate the interior of the reaction base 20 into closed compartments or tanks 24. Some of the tanks 24 may be used for floating stability during towing or controlled ballasting during initial stages of installation of the foundation system 10; some of the tanks 24 may be subsequently used to store raw materials (such as crude oil), processed materials or intermediate process materials.

The peripheral skirt 40 serves to ensure complete contact between the bottom of the reaction base 20 and the underlying soil by containing the soil within an enclosed area. In addition, the peripheral skirt 40 helps minimize any potential scouring around the reaction base 20 caused by underwater sea currents. Deeper skirts may be provided to achieve higher bearing capacity of the entire foundation system 10 by confining a larger volume of soil and transferring the soil bearing stress to deeper soil, which has higher shear strength.

The bottom side of the reaction base 20 has a plurality of jetting nozzles 26. Pressurized water ejected from the jetting nozzles 26 facilitates foundation removal by reducing suction induced at the underside of the reaction base 20 in the course of extracting.

The suction compartment 60 can be of single or multiple units distributed within or along periphery of the reaction base 20. As shown in FIG. 2, two suction compartments 60 are disposed within a transverse section of the reaction base 20. FIGS. 1 and 2 teach that the top of each suction compartment 60 projects a distance H above the underside of the reaction base 20, where the dimension H constitutes a portion of the total depth D of the suction compartment 60. The upper interior parts of each suction compartment 60 are provided with internal bulkheads 64. Although not shown in FIGS. 1 or 2, upper exterior parts of each suction compartment may also be provided with stiffeners. As shown in FIG. 2, radial stiffeners 30 are provided at each intersection between the reaction base 20 and respective suction compartment 60. These radial stiffeners 30 allow stresses to transfer between the two components, as well as to strengthen connection of each suction compartment 60 to the reaction base 20.

An exterior top of each suction compartment 60 has a pump port 80. Each pump port 80 is connectable to a submersible pump 82. In one embodiment, each submersible pump 82 and associated monitoring unit 84 are mounted on the exterior top of each suction compartment 60 and are connectable by umbilical cords to a power pack located on a support vessel (not shown in the figures). In another embodiment, the submersible pump 82 and associated monitoring unit 84 are contained within a remotely operated vehicle (ROV). The specification and numbers of submersible pump 82 required for each suction compartment 60 is dictated by the volume of water inside the suction compartment 60 after initial self-weight penetration into the seabed which needs to be discharged at a rate to create suction pressure within the suction compartment 60. To provide continuous monitoring of a number of separate parameters during foundation positioning and installation, the monitoring units 84 are equipped with various instruments for capturing, for example, inclination; orientation; pumping rate; water pressure inside the suction compartment, position of soil plug and associated penetration depth; and so on. Sensors of these instruments are located in each respective monitoring unit 84. Each submersible pump 82 and associated monitoring unit 84 is detachable to allow their retrieval after the foundation system installation is completed.

In addition, vent hatches and valves 72 are provided at the top, exterior or cap of each suction compartment 60 to let air trapped inside the suction compartments 60 to escape and to prevent water pressure inside the suction compartments 60 from building up during initial foundation penetration. In one embodiment, operation of the vent hatches and valves 72 is executed by ROV intervention. In another embodiment, operation of the vent hatches and valves 72 is interlocked with operation of the associated submersible pump 82. In yet another embodiment, operation of the vent hatches and valves 72 rely on both ROV and submersible pump interlocks.

During foundation installation, after some initial self-weight penetration of a suction compartment 60 and the bottom of the reaction base 20 is in contact with the seabed, the suction compartment is effectively sealed. Pumping water out from inside the suction compartment 60 thus creates a negative pressure differential with respect to ambient hydrostatic pressure outside the suction compartment 60. Due to this pressure differential, the suction compartment 60 penetrates into the seabed and the entire foundation system 10 moves downwards causing the lower part of the reaction base 20 to further penetrate into the seabed. The penetrating foundation system 10 thereby generates pressure build-up on the bottom of the reaction base 20, hereby creating a preloading effect on the foundation system 10. Pumping is maintained until a predetermined soil bearing pressure or a predetermined penetration depth is reached. This suction-induced preloading continues so long as suction is maintained and there is a gap h between the top of the respective suction compartment and soil plug contained therein.

Ratio of suction compartments' projected areas and reaction base area is selected such that the pushing down force created on the top of the suction compartments 60 is sufficient to generate designed soil bearing pressure, preferably, substantially uniformly distributed across the bottom of the reaction base 20. In general, a ratio of 0.5 is adequate for soft clay, however, the actual ratio is determined based on seabed soil condition, arrangement and the depth of the suction compartments 60, amongst some other parameters. With a predetermined reaction base 20 area, determinations of several parameters, such as suction compartment 60 diameter B and depth D, maximum gap height H, maximum applied suction, and pumping rate, are based on site-specific information. Determination of these parameters will ensure effective soil preloading yet preventing potential failure of the soil plug inside the respective suction compartment 60 in the course of suction operation during installation.

Despite the working vertical load naturally shared between the reaction base 20 and suction compartments 60 during in-service stage, it is prudent to design the reaction base 20 per se to carry the expected maximum vertical load. If the vent hatches and valves 72 are completely shut after installation of the foundation system 10, the water cushion filling the gap h remains confined and is able to carry part of the load on the reaction base 20. In other words, the suction compartment skin friction and bearing resistances are not negligible and their contribution to total resistance of the entire foundation system 10 provide additional safety margin.

In an additional embodiment of the foundation system **10*a* according to the present invention, the foundation system 10*a* is made up of three spaced apart circular reaction bases 20, with adjacent reaction bases 20 being connected by bridging structures 21. Each circular reaction base 20 is associated with an annular suction compartment 60. Preferably, the annular compartment 60 is concentric with the respective circular reaction base 20. Similar to the embodiment shown in FIG. 2, a top of the annular suction compartment 60 projects a distance H from the bottom of the circular reaction base 20**.

In yet another embodiment **10*b* of the present invention, the foundation system 10*b* has three reaction bases 20, with each reaction base 20 having two suction compartments 60 disposed at two opposite sides of the respective reaction base 20. Similar to the embodiment 10*a*, adjacent reaction bases 20 are connected by bridging structures 21. These embodiments, where each foundation system 10*a*, 10*b*** is split into multiple units and the spaced apart reaction bases/suction compartments units are bridged to form an integral foundation, may be advantageous on uneven seabed or where considerable lateral variability of seabed shear strength is expected. With multiple units of spaced apart reaction bases/suction compartments, the present invention provides easy control of suction pressure and penetration of each reaction base/suction compartment unit.

FIGS. 3A-3D illustrate the sequential operation process, from installation to extraction, in accordance with an embodiment of the present invention. The foundation system shown in FIGS. 3A-3D are simplified for illustration purposes. The description given hereafter emphasizes geotechnical aspects during preloading and extracting processes because associated marine operations are known to persons skilled in this art.

Figure 3A:
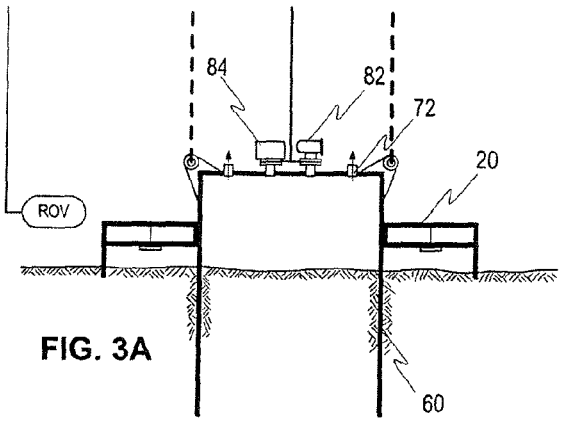
FIGS. 3A-3D illustrate installation and removal processes of the foundation system shown in FIG. 1 in accordance with another embodiment of the present invention.

In FIG. 3A, installation of the above foundation system 10, 10*a*, 10*b* is initiated by water ballasting the reaction base 20 to submerge the entire foundation. To enable controlled submersion and to compensate for increase in hydrostatic pressure as the foundation system 10,10*a*,10*b* is descending, compressed air may be supplied to selected tanks 24. Prior to touch down, the descent rate is reduced with the reaction base 20 and suction compartments 60 vent hatches and valves 72 opened to minimise water trapped below from disturbing the seabed soil. After self-weight penetration and closing of the vent hatches and valves 72, initial penetration of the suction compartment 60 seals the interior of the suction compartment 60; preferably, the bottom of the reaction base 20 comes into contact with the seabed. At this point, the suction compartments 60 are sealed from the outside and penetration into the seabed can be checked from continuous monitoring of the water pressure trapped therein. An ROV may be used to additionally monitor this initial phase of installation.

Figure 3B:
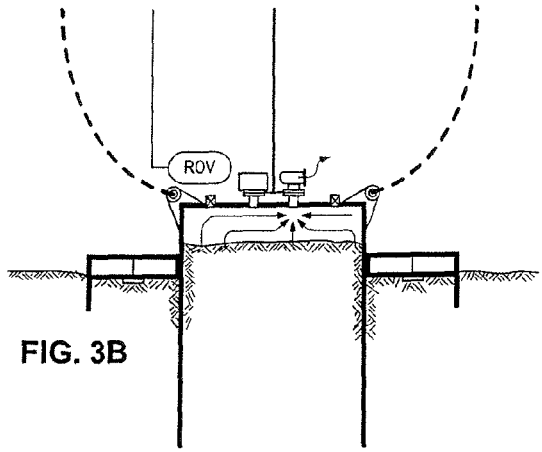

As shown in FIG. 3B, suction preloading is started after shutting the vent hatches and valves 72 and activating the submersible pumps 82. Operations of the vent hatches and valves 72 and the submersible pumps 82 mounted on the top of the suction compartments 60 are performed through umbilical cables with a control station on a support vessel (not shown in the figures). Alternatively, an ROV is used to operate the vent hatches and valves 72 if the vent hatches and valves 72 are designed for remote control operations. Apart from building-up pressure on the bottom of the reaction base 20 and penetration of the entire foundation system 10,10*a*,10*b*, suction created by pumping water out from inside the suction compartments 60 also generates a heave of soil plug inside each suction compartment 60. As the suction operation continues, the soil plug continues to rise towards the top of the associated suction compartment 60. Suction operation is stopped before the soil plug reaches the top of the associated suction compartment so that there is a gap h.

Figure 3C:
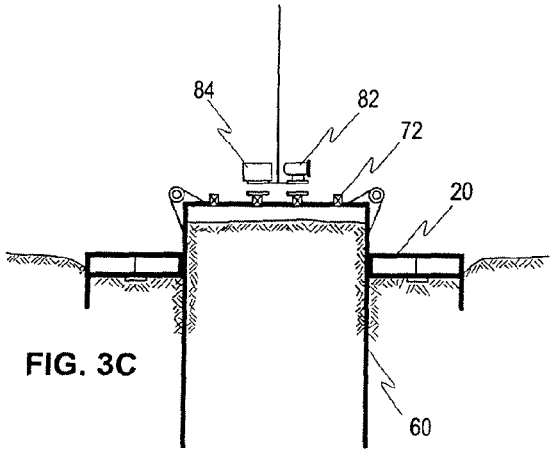

As depicted in FIG. 3C, the installation and preloading processes are completed when the designed soil bearing capacity and/or designed foundation penetration is/are reached. The foundation system 10,10*a*,10*b* is also designed so that the expected maximum penetration does not exceed the thickness of the reaction base 20. In other words, the reaction base 20 is not buried by the surrounding soil when the designed soil bearing capacity or foundation penetration is achieved. In addition, at the end of the installation process, the presence of the gap h between the soil plug and the top of the associated suction compartment 60 allows subsequent removal of the foundation. After remaining suction inside the suction compartments 60 is released and the vent hatches and valves 72 are closed back, the submersible pumps 82, monitoring unit 84 and the umbilical cables are retrieved, and the foundation system 10,10*a*,10*b* is then ready for operation. The installation process may continue in cases whereby the foundation system 10,10*a*,10*b* is to be integrated with an upper connecting structure above the reaction base 20 through subsequent marine operations.

Figure 3D:
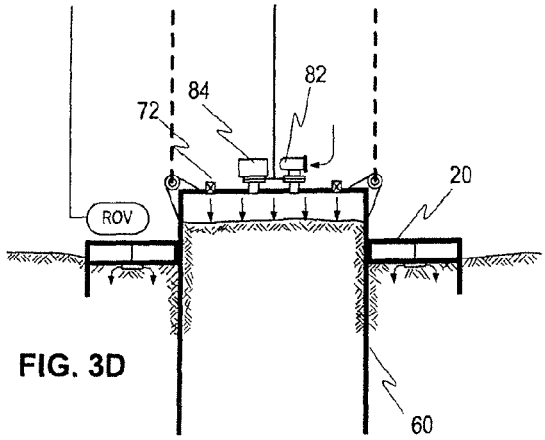

At the end of use of the offshore structure at a site, the foundation system 10,10*a*,10*b* may need to be relocated to another site. As shown in FIG. 3D, extraction of the foundation system is initiated by exerting some pulling force on the foundation system 10,10*a*,10*b* by means of barges or other support vessels after detaching and removing any connected upper structure. With the assistance of an ROV, a submersible pump 82 is connected to each associated pump port 80. In another embodiment, a pressure line is connected to each associated pump port 80 with pumps being located on-board the supporting vessels (not shown in the figures). By pumping water into the gap h inside each suction compartment 60, positive pressure in excess of the ambient hydrostatic pressure generates a force to push up the entire foundation system 10,10*a*,10*b*; this is in substance, a reversal of the installation process. During extraction, water jetting lines may be additionally supplied to the jet nozzles 26 disposed at the bottom of the reaction base 20 to help accelerate the extraction process.

As can be seen from the above description, an advantage of the present invention is that suction-induced preloading of the foundation system 10,10*a*,10*b* is carried out independently of the upper structure which is to be supported; this means reducing risks associated with installation of foundation system on problematic seabed or when installation time-window is relatively short. For example, as the foundation system may be independent of the upper structure, it is easy for a mobile drilling platform to be removed and re-deployed during periods of harsh weathers. In addition, installation does not rely on external ballast tanks, which are conventionally provided on the upper supporting structure. Further, installation and/or extraction of the foundation system 10,10*a*, 10*b* involve lesser dependence on supporting surface vessels. In terms of stability of the foundation system 10,10*a*,10*b*, the presence of suction compartment(s) 60 distributed at various locations within and/or around the reaction base 20 area allows better controlled penetration; that is, by pumping water out from inside different suction compartments 60 at different rates, differential soil penetrations can be accommodated. The suction compartment(s) 60, which extend downwardly from the reaction base 20 form internal skirts, and these help improve the foundation system 10,10*a*,10*b* stability by providing rotational resistance, which is often caused by load eccentricity, as well as horizontal resistance.

Apart from the ease of foundation system installation and preloading, the present invention is also advantageous in extraction. Extraction is carried out with equal ease by substantially reversing the installation process.

A series of centrifuge experiments were carried out at the University of Western Australia (UWA) to investigate the fundamental behavior of an embodiment of the foundation system 10,10*a*,10*b* according to the present invention. A circular skirted reaction base 10 with a concentric suction compartment 60, similar to that depicted in FIGS. 3A-3D, was installed in normally consolidated clay. In addition, another foundation system using conventional, direct preloading method using deadweights was installed to benchmark effectiveness of the suction-induced preloading. The penetration-resistance characteristics of the entire foundation system 10,10*a*,10*b* observed in the experiments are shown in FIGS. 4A and 4B, respectively, for undrained and drained loading conditions, the latter condition corresponding to soil being fully consolidated.

Figure 4A:
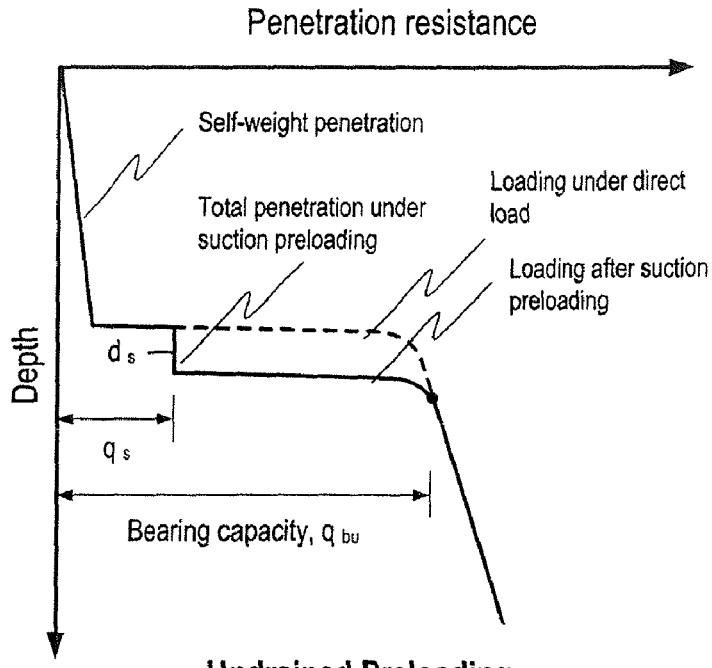
FIGS. 4A-4B illustrate load-penetration characteristics of the foundation system shown in FIG. 1 in accordance with yet another embodiment of the present invention.

As shown in FIG. 4A, the initial stage of installation by direct preload results in a sudden increase in soil bearing pressure after the bottom of the reaction base 20 comes into contact with the soil, literally at a penetration depth equal to the reaction-base's peripheral skirt 40 height. Upon further loading, the foundation penetrates further until the full bearing capacity $q_{bu}$ is reached. With suction preloading method of the present invention, when suction is applied within the suction compartments 60 after initial self-weight penetration, the foundation system 10,10*a*,10*b* penetrates the soil (corresponding to $d_s$) with much less resistance (corresponding to $q_s$) than that during direct preloading. In this instance, the applied suction is regulated such that the resulting soil pressure at the reaction base 20 equals the anticipated maximum working pressure, thereby, literally simulating a preload. After reaching a final penetration depth and the suction pressure was then released, the foundation system 10,10*a*,10*b* was loaded to verify its bearing capacity; the loading of the foundation system 10,10*a*,10*b* shows that the ultimate bearing capacity at the final penetration depth is substantially equivalent to that achieved by direct preload. In other words, under undrained soil condition the above two installation methods generate similar virgin soil bearing capacity curves.

Figure 4B:
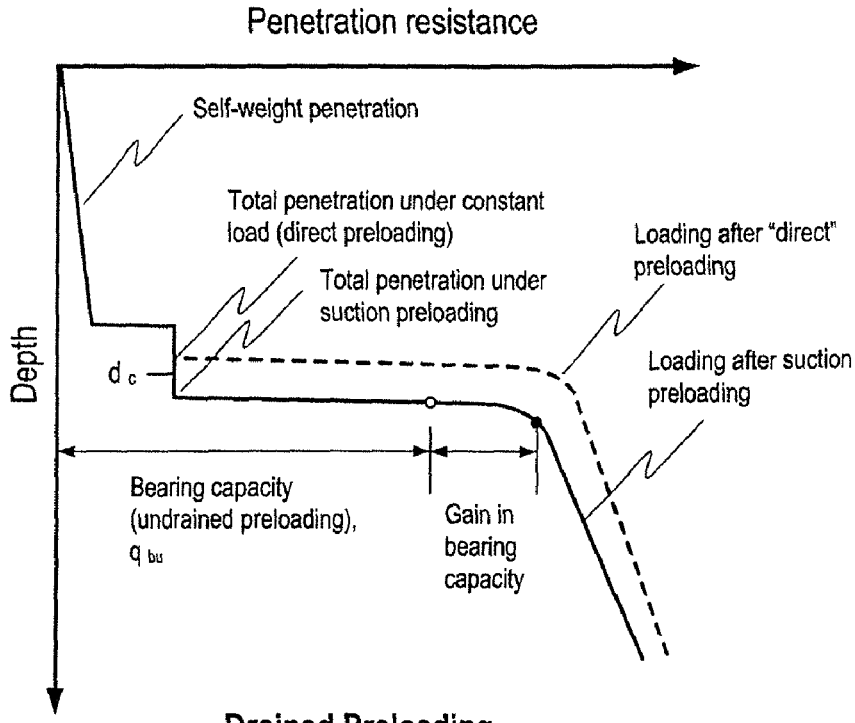

FIG. 4B illustrates the behavior of suction-preloading according to the present invention by allowing soil consolidation during suction operation; this is also called drained preloading. With some soil consolidation taking place and the associated settlement (corresponding to $d_c$) when suction is maintained for a period of time, there is an increase in soil bearing capacity over that of undrained condition. The increased soil bearing capacity resulting from the suction-preloading of the present invention approaches that achieved by direct preloading if the same soil bearing pressure at the reaction base is maintained for the same duration.

While specific embodiments have been described and illustrated, it is understood that many changes, modifications, variations and combinations thereof could be made to the present invention without departing from the scope of the invention. For example, some of the ballast tanks in the reaction base 20 may be equipped with valves and pumps for emptying the respective ballast tanks and then filling them with raw, semi-processed or processed materials.

What is claimed is:

1. An offshore foundation system comprising:

a reaction base in the form of a hollow slab, which has an upper surface and a bottom surface, the upper and bottom surfaces defining a thickness of the reaction base; and a suction compartment in the form of a substantially open-bottom and closed-top cylindrically elongate shell, wherein the closed top has a pump port with vent hatches and valves allowing the air and water trapped in the cylindrically elongate shell to be pumped out during installation when the pump port is connected to a suction pump;

wherein the suction compartment is integrally formed with the reaction base so that the open-bottom of the suction compartment opens downward with a longitudinal axis of the elongate shell substantially perpendicular to the bottom surface of the reaction base and the closed-top projects a distance H above the bottom surface of the reaction base, such that, in use, there is a gap h between a top of a soil plug inside the suction compartment and the closed-top.

2. An offshore foundation system according to claim 1, wherein the suction compartment comprises a plurality of suction compartments.

3. An offshore foundation system according to claim 1, wherein the foundation system comprises a plurality of reaction base/suction compartment foundation system units, said foundation system units being connected by bridging structures to form an integral base.

4. An offshore foundation system according to claim 3, wherein in each reaction base/suction compartment foundation system, one or more suction compartments are associated with each reaction base.

5. An offshore foundation system according to claim 1, further comprising a frame structure disposed on the upper surface of the reaction base to facilitate mating with an upper structure.

6. An offshore foundation system according to claim 1, wherein the reaction base further comprises bulkheads that separate the interior of the hollow slab into tanks, which are operable as ballast or storage tanks.

7. An offshore foundation system according to claim 1, wherein the gap h is used for the extraction of the offshore foundation system.

8. A method for installing and preloading an offshore foundation system, the method comprising:

forming the offshore foundation system according to claim 1;

submerging the offshore foundation system so that the suction compartment(s) penetrate into the seabed under substantial self-weight of the foundation system;

closing the vent hatches and valves associated with the or respective suction compartment;

once water inside the or respective suction compartment is sealed, operating the suction pump associated with the or respective suction compartment to pump water out from inside the or respective suction compartment so that a negative pressure differential with respect to the ambient hydrostatic pressure at the top of the or respective suction compartment generates a force to push the entire foundation into the seabed; and continuing with the suction-induced driving of the or respective suction compartment into the seabed until the bottom surface of the associated reaction base penetrates further into the seabed so that the resulting soil bearing pressure reaches a predetermined value and a gap h between a top of a soil plug and the closed-top of the or respective suction compartment remains, without relying on additional or external ballasts.

9. A method according to claim 8, wherein the suction-induced driving of the or respective suction compartment is continued until the associated reaction base reaches a predetermined penetration.

10. A method according to claim 9, wherein the suction-induced driving of the or respective suction compartment is continued for a period of time until no further substantial soil penetration occurs and the soil underneath the foundation system is consolidated.

11. A method according to claim 8, wherein the offshore foundation system is operable for extraction by pumping water into the gap h when the vent hatches and valves are closed, so that a positive pressure differential with respect to the ambient hydrostatic pressure at the top of the or respective suction compartment generates a force to push up the or respective suction compartment and entire foundation system from the seabed.

* * * * *